US008628207B2

(12) United States Patent
AlOsaimi

(10) Patent No.: US 8,628,207 B2
(45) Date of Patent: Jan. 14, 2014

(54) BATON FOR POLICE

(76) Inventor: Zafer J. S. M. AlOsaimi, Soubah Alsalem (KW)

( * ) Notice: Subject to any disclaimer, the term of this patent is extended or adjusted under 35 U.S.C. 154(b) by 209 days.

(21) Appl. No.: 13/160,815

(22) Filed: Jun. 15, 2011

(65) Prior Publication Data

US 2012/0320567 A1 Dec. 20, 2012

(51) Int. Cl.
*F21V 33/00* (2006.01)

(52) U.S. Cl.
USPC ..... 362/109; 362/110; 362/111; 362/112; 362/113; 362/114; 362/119; 362/120; 362/577

(58) Field of Classification Search
USPC ..... 362/577, 109–114, 119, 120
See application file for complete search history.

(56) References Cited

U.S. PATENT DOCUMENTS

| | | | | |
|---|---|---|---|---|
| 2,124,172 | A | 7/1938 | Wildes et al. | |
| 2,966,621 | A | 12/1960 | Voll | |
| 3,728,809 | A | 4/1973 | Mulich et al. | |
| 4,842,277 | A | 6/1989 | LaCroix | |
| 5,364,097 | A | 11/1994 | Lyon | |
| 5,808,226 | A | 9/1998 | Allen et al. | |
| 5,839,967 | A | 11/1998 | Moe | |
| 6,615,622 | B2 * | 9/2003 | MacAleese et al. | 70/16 |
| 7,267,453 | B2 | 9/2007 | Chang et al. | |
| 8,231,474 | B2 * | 7/2012 | Stethem | 463/47.3 |
| 2002/0163799 | A1 * | 11/2002 | Kukuk | 362/102 |
| 2005/0073798 | A1 * | 4/2005 | Stethem | 361/232 |
| 2005/0188886 | A1 * | 9/2005 | Vasel et al. | 102/502 |

* cited by examiner

*Primary Examiner* — William Carter
(74) *Attorney, Agent, or Firm* — Lowe Hauptman & Ham, LLP

(57) ABSTRACT

A police baton or nightstick includes a flashlight, firing mechanism and storage compartment for bullets and plastic restraints that can be used to restrain an individual. The baton which includes an elongated hollow body with first and second ends and a handgrip at a first of the ends and a hard weighted portion at the second end for striking an individual in self-defense or to subdue an unruly individual. The firing mechanism is included at the first end of the baton while compartments for storing one or more plastic restraints as well as bullets are stored underneath a barrel of the firing mechanism.

2 Claims, 3 Drawing Sheets

BATON FOR POLICE

FIELD OF THE INVENTION

This invention relates to a police baton, or nightstick and more particularly to a police baton or nightstick with an integral flashlight, firing mechanism and storage for plastic restraints that can be used to immobilize an individual.

BACKGROUND FOR THE INVENTION

Batons or nightsticks carried by Police Officers are well known and have been in use for many years. Such batons have also been combined with other devices. For example, a projectile launcher baton is disclosed in a U.S. Pat. No. 3,728,809 of Mulich et al. As disclosed therein a projectile launcher in the form of a stun baton or nightstick, which is comprised of a barrel assembly having a receiver therein with in its inward end, and a coaxial handle assembly which includes a firing mechanism, a firing mechanism safety, and a breech member disposed at one end thereof. The receiver end of the barrel assembly and the breech end of the handle assembly are respectively connected to opposing halves of a novel split collar ring. The halves of the collar ring are hinged axially for rotatably pivoting the handle portion transversely with the face of the receiver to provide for insertion of the projectile, and after firing for removal of the spent cartridge. A releasable locking mechanism is further provided to lock and align the assemblies in coaxial orientation whereupon release of the mechanism allows the pivotable rotation of the assemblies for disassociation therewith.

A more recent U.S. patent of LaCroix, U.S. Pat. No. 4,842,277 discloses a multi-purpose baton that serves as a baton or nightstick in a conventional way, with an additional self-contained operational provision when selectively activated for providing threatening sparking along the projecting length portion thereof, a concentrated continuous ring like threatening sparking around the projecting end thereof and/or the emitting of a temporary laser beam of light from the projecting end thereof. The blinding of a person lasts only during the operation of the laser light of the improved hand carried stick. When a person or persons must be threatened to be subdued or be subdued by a person charged with law enforcement, the self contained electrical energy of this baton is supplied by one of two 9 volt direct current batteries. The electrical energy is converted via self contained electrical components with 50,000 volts of electrical energy available for discharge at two microamperes of current. The discharges via sparking, occur along and across spaced pairs of positive and negative charged conductive strips longitudinally positioned along the projecting length portion of the baton or stick to create the threatening observable random sparking during all operational discharge times. Also, if these unlike charged pairs of conductive strips are touched then the person so touching is quickly subdued by receiving the 50,000 volts at this low current.

Finally, a baton with an integral projectile launcher is disclosed in a U.S. Pat. No. 3,728,809 of Lyon. As disclosed in the Lyon patent, a police baton side arm having a baton main body and a cross handle which is attached in a perpendicular manner to the baton main body at a position longitudinally displaced from the geometric center of the baton main body. The baton main body also houses a recessed trigger ahead of the cross handle and means for launching a projectile. In order to achieve impact insensitivity a double action only firing mechanism is employed. The baton main body is constructed in two parts to accommodate breech loading and various connection schemes including interrupted and multi-load threads on abutting portions of the baton main body. Guide rods or enhanced mechanisms may be provided to accommodate one handed loading. The police baton may also be equipped with a gun sight and a laser pointing device for improving the accuracy of the user's aim.

Notwithstanding the above it is presently believed that there is a need and a potential commercial market for an improved police baton or nightstick in accordance with the present invention. There should be a need for such batons because they include an integral flashlight, firing mechanism and a storage area for plastic restraints that can be used to immobilize an individual. Further, it is believed that the baton in the present invention will provide a police officer with a compact defense weapon as well as a weapon that can be used to arrest and detain wrong doers and to be more effective in carrying out their duties to maintain a peaceful environment. In addition, it is believed that batons in accordance with the present invention are sturdy, relatively compact and can be produced at a competitive cost.

BRIEF SUMMARY OF THE INVENTION

In essence a police baton or nightstick in accordance with the present invention includes an integral flashlight, a firing mechanism and storage for a plurality of plastic restraints for immobilizing an individual. The baton comprises or consists of an elongated hollow body having first and second ends with a handgrip for gripping the baton at the first or proximal end thereof. The distal end of the baton is made of a hard weighted material for striking an individual in self defense and subduing an unruly individual. In a preferred embodiment of the invention the baton includes a flashlight and a firing mechanism that may include a forwardly extendable barrel, a trigger and a plurality of bullets. The bullets may be conventional or rubber depending on the matter to be confronted. The baton also includes a storage area for plastic restraints that may be used to confine an individual's arms and hands behind their back.

In a preferred embodiment of the invention, the baton or nightstick may be provided in three separate forms or embodiments. In a first embodiment, the baton includes a rifle with three openings along the horizontal axis. For example, a first opening is aligned with the barrel of the firearm and allows a bullet or shotgun load to leave the club. A second opening is provides access to a plurality of shackles while a third opening allows access to a flashlight.

In a second embodiment of the invention the baton or nightstick includes an electrical discharge device or electroshock weapon (taser) for use in controlling an unruly individual. In this embodiment there is a battery and an opening for connecting a battery charger as well as an opening for access to a plurality of plastic shackles.

A third embodiment of the invention the baton or club includes only two openings, one for access to a flashlight and another for access to a plurality of shackles.

The invention will now be described in accordance with the following figures wherein like numbers have been used to illustrate like parts.

DESCRIPTION OF THE PREFERRED EMBODIMENTS OF THE INVENTION

Figure 1:
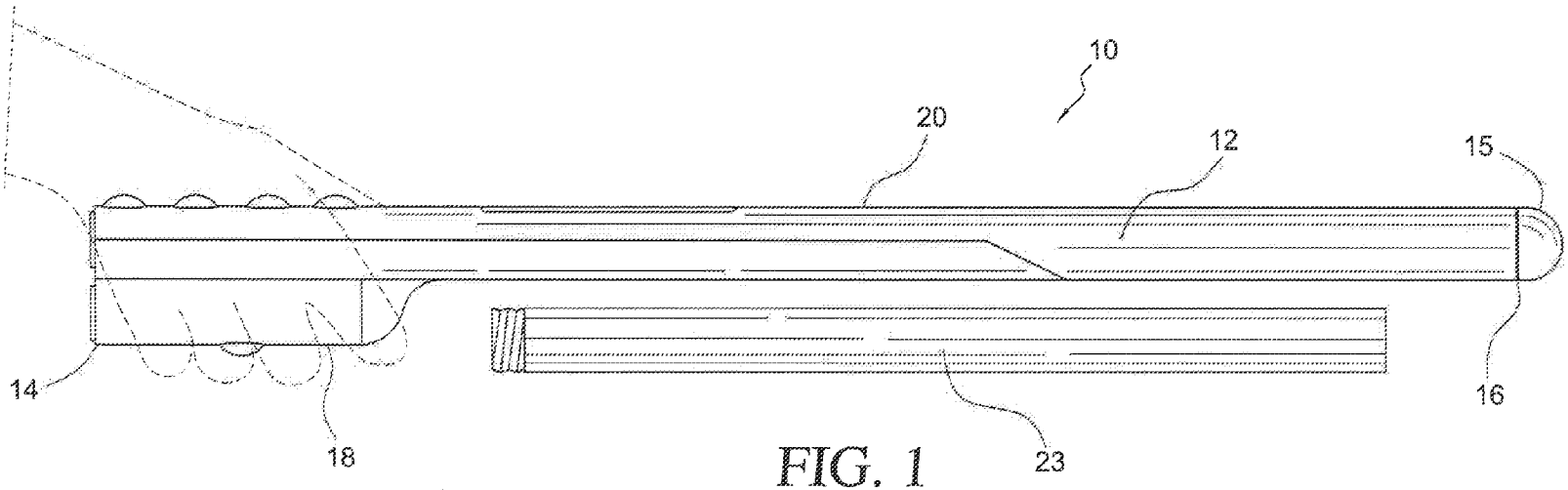
FIG. 1 is a side elevational view of a police officer's baton in accordance with the present invention.

Referring now to FIG. 1, a police baton or nightstick 10 in accordance with the present invention includes an elongated hollow body 12 having a first or proximal end 14 and a second or distal end 16. A handgrip 18 is formed on the first or proximal end 14 that may have a reduced cross-section to provide a more comfortable grip. The second or distal end 16 is formed of a hard material such as oak and includes a metal barrel extending along the length of the baton. A wooden cap or solid plug 15 is used to close the end of the baton, but may be readily removed by being unscrewed or pulled free from a friction fit.

In one preferred embodiment of the invention a second portion 22 of the barrel 20 is stored parallel to a first portion and is adapted to be screwed into the first portion of the barrel 20. The end of the baton also includes a wooden cap or solid plug 15 or enclosure that is removable from the end of the baton by being unscrewed or removed therefrom before screwing the second portion 23 of the barrel 20 into a first portion 21. However, the second portion 23 of the barrel 20, adds weight and sturdiness to the distal end 16 of the baton 10.

In essence, the baton 10 in accordance with the preferred embodiment of the invention provides a police officer with the equivalent of up to three nightsticks in a single nightstick. For example, a first embodiment is used for self-defense and/or subduing an unruly individual by striking him or her on the head when necessary. The nightstick may also include a shortened rifle barrel and a trigger mechanism for firing rubber or real bullets plus a laser for focusing on a target as well as a flashlight disposed in the first or proximal end of the elongated body 12 and a pair of outwardly and forwardly extending prongs 42 that are connected to the stun gun 40 by a pair of electrical cables 43. The stun gun 40 is also connected to a rechargeable battery 44 that in turn is connected to a battery charger 46 that can be connected to an ordinary electrical outlet (not shown) by an electrical connector 45.

Figure 2:
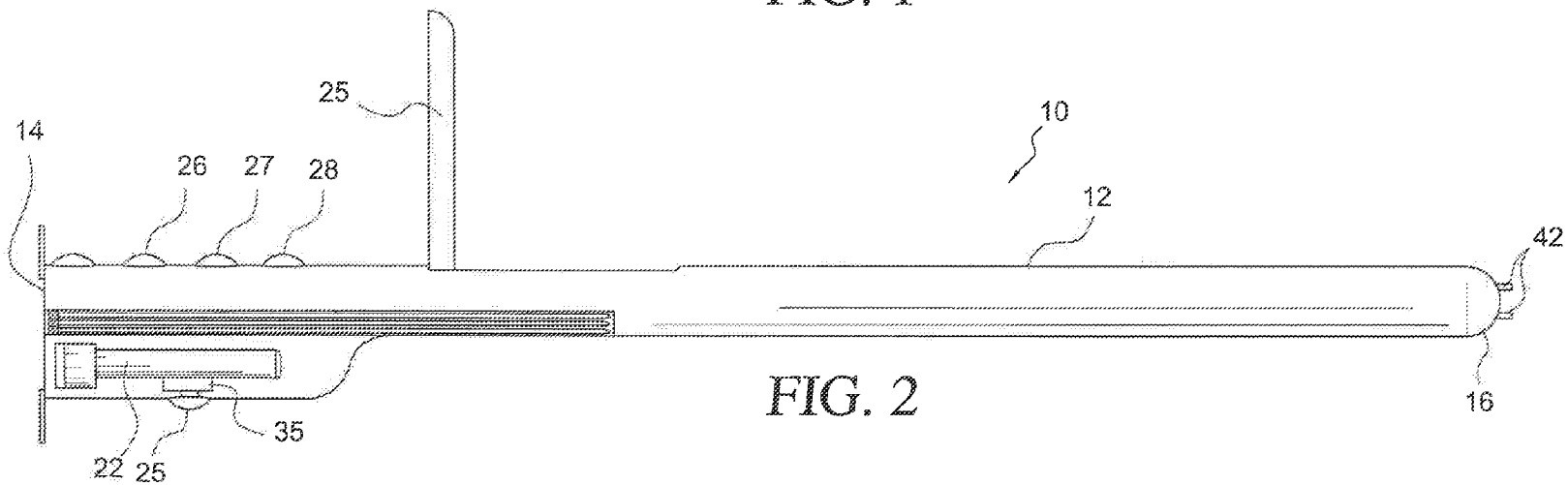
FIG. 2 is a side elevational view of the police officer's baton shown in FIG. 1 but with an extended cross grip for holding the baton with two hands for control of an unruly crowd.

In a second embodiment of the invention the nightstick or elongated body 12 includes an electrical device or stun gun 40 as shown in FIG. 2, a hand torch 22 that can be used is maintained in the elongated body 12 or removed therefrom and a storage space for plastic restraints and bullets is provided. In this embodiment an additional opening is provided for access to an electrical charger.

Figure 3:
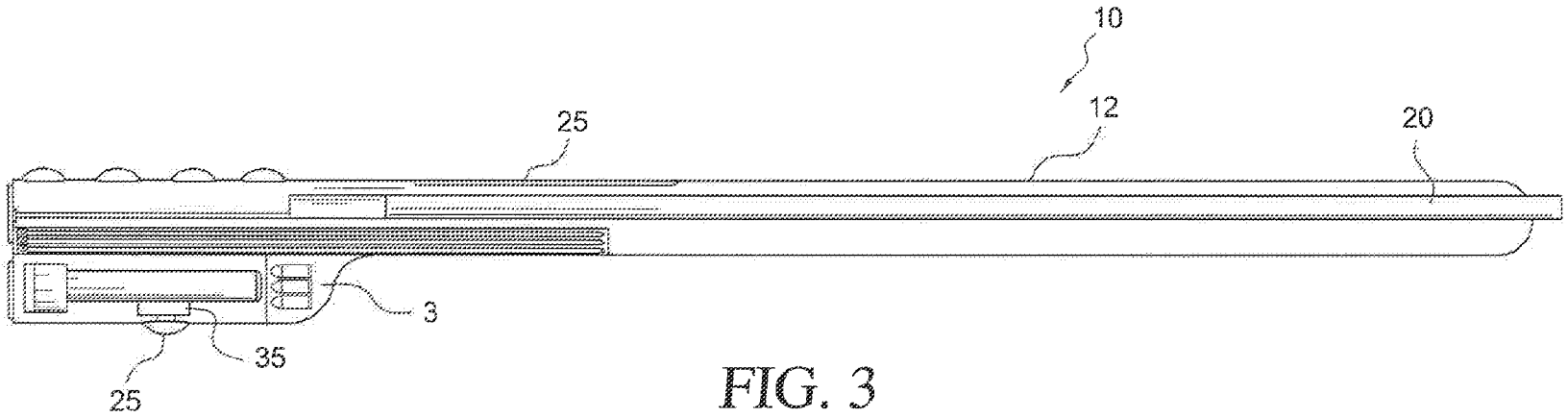
FIG. 3 is a side elevational view of a police officer's baton with a flashlight, barrel and three plastic restraints disposed in a chamber parallel to the barrel.

In a third embodiment of the invention as illustrated in FIG. 3, the elongated body is also used as a nightstick for self defense and includes a storage space for and/or plastic restraints. In this embodiment, the hollow body also includes a second portion with an extension of a rifle barrel that provides a firearm with a barrel of conventional length for accuracy. It is also contemplated that a rifle barrel can be replaced by a shotgun barrel and that the rifle is replaced by a shotgun.

Figure 4:
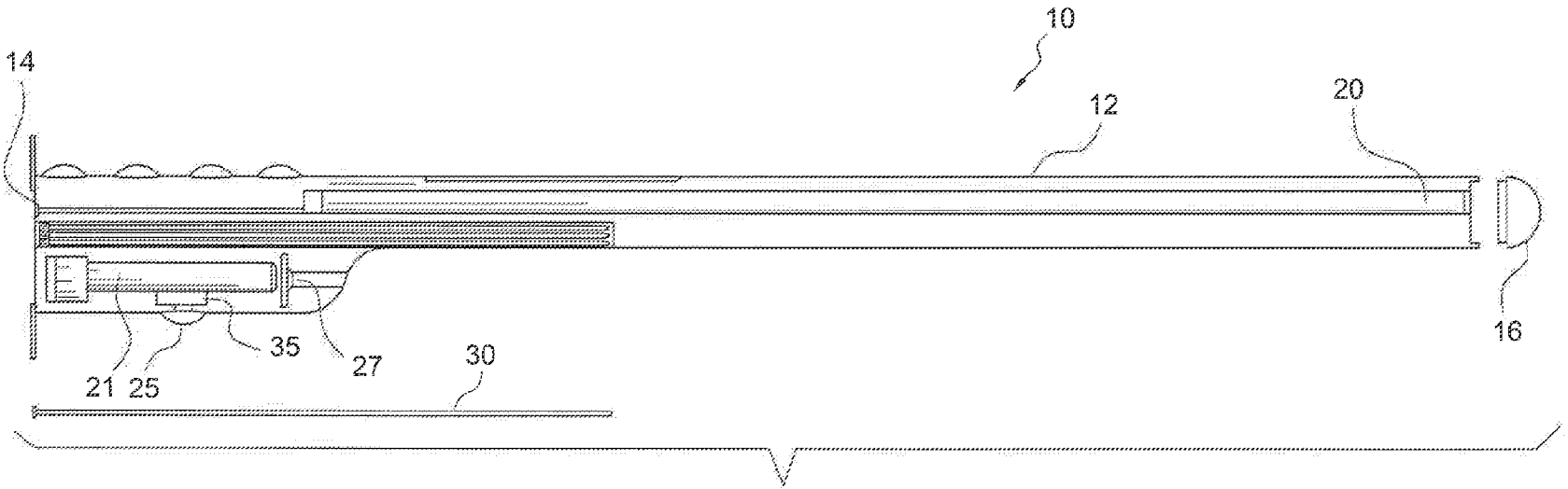
FIG. 4 is a schematic illustration of a baton with a rifle barrel in a compressed state.
Figure 5:
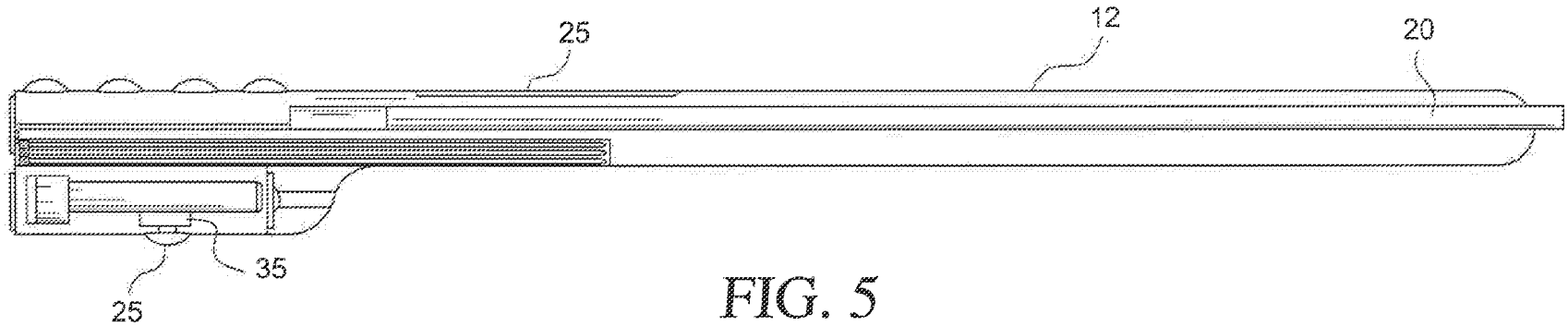
FIG. 5 is a side elevational view of a baton with a rifle barrel in a firing position and a laser sighting device disposed in a lower portion thereof.

Referring now to FIG. 4, a nightstick or baton 10 includes an elongated body 12 having a proximal end 14 and distal end 16. The distal end 16 may be removable to expose a rifle or shotgun barrel 20 in a firing position. The elongated body 12 also includes a space for a flashlight 21 that faces outwardly at the proximal end 13 or that can be removed therefrom. As shown in FIG. 3, a second handle 25 in an upper portion of the body 12 can be folded upwardly at a 90° angle to the body 12 for using a second hand in holding the baton 10 with both hands. When not in use, the second handle 25 is folded flat to form a smooth outer side of the baton 10. As shown, a laser sighting device 27 may also be disposed in the hollow body 12.

The elongated body 12 also includes one or more buttons or the like 26, 27 and 28 for opening the chamber for the second handle 25, containing a number of restraints and trigger for firing the firearm. A rod 30 may also be disposed within the elongated body 12. This rod 30 can be used to release a safety latch to release a firing button or trigger for firing the firearm. The rod 30 can also be used to open an ammunition chamber 3 containing bullets or shotgun shells.

Figure 6:
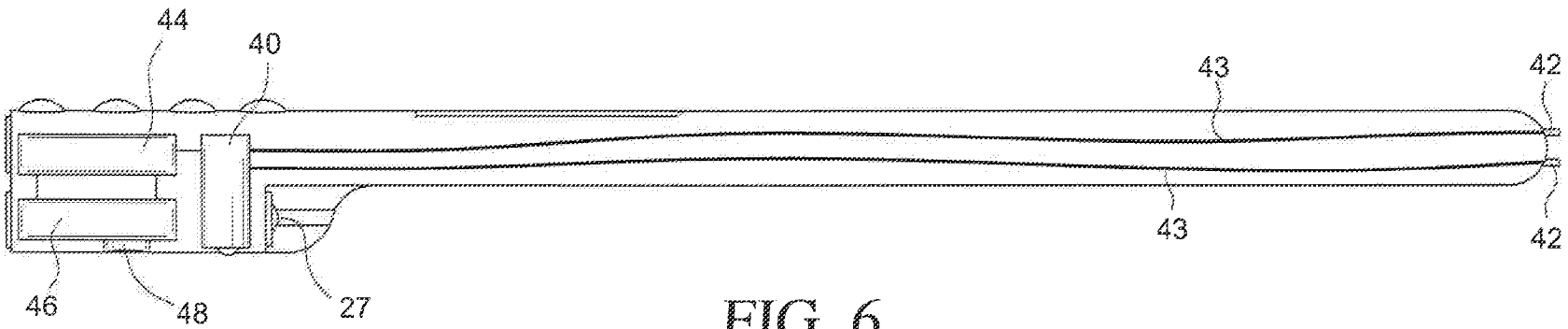
FIG. 6 is a side elevational view of a police officer's baton with a laser sighting mechanism and an electric discharge device or stun gun.

A battery 44 is also disposed in the hollow body 12 for energizing the taser by means of a wire contact and switch 45. A battery charger 46 is also shown in FIG. 6. A switch 35 in a bottom portion of the elongated body 12 is used to turn on or off the flashlight by means of a button 25.

Means such as a plurality of button releases are provided for releasing the flashlight, or obtaining access to the plastic restraints and/or activating the firing mechanism and/or discharging electricity across a pair of electrodes in contact with an individual's body.

While the invention has been described in connection with its preferred embodiment, it should be recognized that changes and modifications may be made therein without departing from the scope of the appended claims.

What is claimed is:

1. A police baton or nightstick with a flashlight, firearm, firing mechanism and storage for plastic restraints that can be used to immobilize an individual, said baton consisting of:

an elongated hollow body having a first end, a second end and a handgrip at a first of said ends, an open second end and a removable solid wooden plug that is removable from said second open end of the baton and a hard weighted wood portion at said second end for striking an individual in self-defense or to subdue an unruly individual, a second handgrip pivotally disposed within said baton and releaseable into a transverse position for gripping with a second hand;

an electrical discharge device and a rechargeable battery disposed in said elongated hollow body with two spaced apart electrodes extending out of said second end for subjecting an unruly individual to neuromuscular incapacitation;

a removable flashlight, a shortened rifle or shotgun barrel, a trigger and firing mechanism disposed within said elongated hollow body and a storage space and a plurality of bullets and a plastic restraint disposed in said storage space in said hollow body below said barrel and a laser sighting device disposed in said hollow body for sighting along said barrel and a charger disposed in said hollow body.

2. A police baton or night stick with a removable flashlight and an electrical discharge device for neuromuscular incapacitation, a firearm, firing mechanism and storage for plastic restraints, said baton or night stick consisting of:

an elongated hollow body having a first end, a second open end and a first handgrip at a first of said ends, a hard weighted wood portion at said second open end for striking an individual in self-defense or to subdue an unruly individual and a removable solid wood plug that is removable from said second open end of said body, a second handgrip pivotally disposed on said baton and releaseably positioned into a transverse position near said first handgrip for gripping with a second hand;

an electrical discharge device and a rechargeable battery disposed in said elongated hollow body with two spaced apart electrodes extending out of said second end for subjecting an unruly individual to neuromuscular incapacitation;

a flashlight releaseably stored within said hollow body and an opening with access to said battery for recharging said battery;

a shortened rifle or shotgun barrel, a trigger and firing mechanism disposed with said elongated hollow body and a second portion of said barrel stored parallel to said barrel and adapted to be screwed into said barrel; and means for releasing said flashlight from said hollow body and separate means for discharging voltage across said electrodes when said electrodes come into contact with an individual's body.

* * * * *